US009261892B2

(12) United States Patent
Wang et al.

(10) Patent No.: US 9,261,892 B2
(45) Date of Patent: Feb. 16, 2016

(54) LOW-DROPOUT VOLTAGE REGULATOR APPARATUS CAPABLE OF ADAPTIVELY ADJUSTING CURRENT PASSING THROUGH OUTPUT TRANSISTOR TO REDUCE TRANSIENT RESPONSE TIME AND RELATED METHOD THEREOF

(71) Applicant: Silicon Motion Inc., Hsinchu County (TW)

(72) Inventors: Tsun-Hsin Wang, Yunlin County (TW); Chiao-Hsing Wang, Taoyuan County (TW)

(73) Assignee: Silicon Motion Inc., Jhubei, Hsinchu County (TW)

( * ) Notice: Subject to any disclaimer, the term of this patent is extended or adjusted under 35 U.S.C. 154(b) by 150 days.

(21) Appl. No.: 14/205,395

(22) Filed: Mar. 12, 2014

(65) Prior Publication Data

US 2014/0285165 A1 Sep. 25, 2014

(30) Foreign Application Priority Data

Mar. 21, 2013 (TW) ..... 102110060 A

(51) Int. Cl.
*G05F 1/56* (2006.01)
*G05F 1/575* (2006.01)

(52) U.S. Cl.
CPC . *G05F 1/56* (2013.01); *G05F 1/575* (2013.01)

(58) Field of Classification Search
CPC ..... G05F 1/56; G05F 1/565; G05F 1/575; H02M 3/156; H02M 3/157; H02M 3/1584; H02M 3/1588
USPC ..... 323/271–274, 282, 283, 351
See application file for complete search history.

(56) References Cited

U.S. PATENT DOCUMENTS 6,806,690 B2 * 10/2004 Xi ..... G05F 1/575 323/273
7,683,592 B2 3/2010 Soude
8,482,266 B2 * 7/2013 Yu ..... G05F 1/575 323/280
8,917,070 B2 * 12/2014 El-Nozahi ..... G05F 1/565 323/273

FOREIGN PATENT DOCUMENTS

CN 101421683 A 4/2009
TW M386518 8/2010
TW 201033779 9/2010

* cited by examiner

*Primary Examiner* — Adolf Berhane
*Assistant Examiner* — Yemane Mehari
(74) *Attorney, Agent, or Firm* — Winston Hsu; Scott Margo

(57) ABSTRACT

A low-dropout voltage regulator apparatus includes a voltage source circuit, an error amplifier, an output transistor, a resistor-capacitor circuit, a detection circuit, and a current adjusting circuit. The voltage source circuit generates a reference voltage signal and at least one threshold voltage signal. The error amplifier receives the reference voltage signal and a feedback voltage signal to generate an output control signal. The output transistor provides an output current for the output terminal according to the output control signal. The resistor-capacitor circuit generates the feedback voltage signal using voltage dividing according to a voltage corresponding to the output current. The detection circuit compares at least one threshold voltage signal with the output voltage to generate at least one control voltage signal. The current adjusting circuit adaptively adjusts the current passing though the output transistor to decrease the transient response time according to the at least one control voltage signal.

17 Claims, 6 Drawing Sheets

LOW-DROPOUT VOLTAGE REGULATOR APPARATUS CAPABLE OF ADAPTIVELY ADJUSTING CURRENT PASSING THROUGH OUTPUT TRANSISTOR TO REDUCE TRANSIENT RESPONSE TIME AND RELATED METHOD THEREOF

BACKGROUND OF THE INVENTION

1. Field of the Invention

The disclosed embodiments of the present invention relate to a low-dropout voltage regulator mechanism, and more particularly, to a low-dropout voltage regulator apparatus which is capable of adaptively adjusting the current passing through the output transistor to reduce the transient response time and related method thereof.

2. Description of the Prior Art

Generally speaking, a conventional low-dropout (LDO) voltage regulator generates and outputs a stable output voltage to the following circuit under an ideal operation. However, in practical designs and operations, loop bandwidth of a low-dropout voltage regulator may have a frequency range from hundreds of KHz to dozens of MHz. Therefore, the conventional low-dropout voltage regulator has a poor transient response for an output current load. For instance, when the load of the conventional low-dropout voltage regulator is changed from a light load to a heavy load, the conventional low-dropout voltage regulator requires more transient response time to provide a stable and balanced output current for the following circuit. Hence, the load change of the conventional low-dropout voltage regulator induces a dramatic voltage change such as a voltage dip. In addition, when the load of the conventional low-dropout voltage regulator is changed from a heavy load to a light load, the conventional low-dropout voltage regulator requires more transient response time to gradually reduce the degree of conduction of the output power transistor. Hence, the load change of the conventional low-dropout voltage regulator induces a dramatic voltage change such as a sudden voltage jump.

A conventional solution is provided with a very large external regulating capacitor intended to reduce the dramatic voltage change at the transient response time; however, this very large external regulating capacitor not only dramatically increases the production cost, but also reduces the original loop bandwidth and thus deteriorates the regulator performance.

SUMMARY OF THE INVENTION

Therefore, one of the objectives of the present invention is to provide a novel low-dropout regulator apparatus and related method to reduce the dramatic voltage change of the output voltage at transient response time while switching between different loads, and achieve the effect of reducing transient response time as well.

According to an embodiment of the present invention, a low-dropout regulator apparatus is disclosed. The low-dropout regulator apparatus includes a voltage source circuit, an error amplifier, an output transistor, a resistor-capacitor circuit, a detection circuit and a current adjusting circuit. The voltage source circuit is arranged to generate a reference voltage signal and at least one threshold voltage signal. The error amplifier is coupled to the voltage source circuit, and is arranged to receive the reference voltage signal and a feedback voltage signal to generate an output control signal. The output transistor is coupled to the error amplifier, and is arranged to receive the output control signal and provide an output current for the output terminal according to the output control signal. The resistor-capacitor circuit is coupled to the error amplifier and the output transistor, and is arranged to generate the feedback voltage signal by performing voltage dividing according to a voltage corresponding to the output current. The detection circuit is coupled to the voltage source circuit, and is arranged to receive the at least one threshold voltage signal and an output voltage on the output terminal, and compare at least one threshold voltage signal with the output voltage to generate at least one control voltage signal. The current adjusting circuit is coupled to the output terminal, the detection circuit and the error amplifier, and is arranged to adjust the output control signal generated by the error amplifier and adaptively adjust a current passing through the output transistor according to the at least one control voltage signal, so as to decrease a transient response time of the low-dropout voltage regulator.

According to another embodiment of the present invention, a method used in low-dropout voltage regulator apparatus is disclosed. The method includes: utilizing a voltage source circuit to generate a reference voltage signal and at least one threshold voltage signal; utilizing an error amplifier to receive the reference voltage signal and a feedback voltage signal to generate an output control signal; utilizing an output transistor to receive the output control signal and provide an output current for the output terminal according to the output control signal; generating the feedback voltage signal by performing voltage dividing according to a voltage corresponding to the output current; receiving the at least one threshold voltage signal and an output voltage on the output terminal, and comparing at least one threshold voltage signal with the output voltage to generate at least one control voltage signal; and adjusting the output control signal generated by the error amplifier and adaptively adjusting a current passing through the output transistor according to the at least one control voltage signal, so as to decrease a transient response time of the low-dropout voltage regulator.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1A:
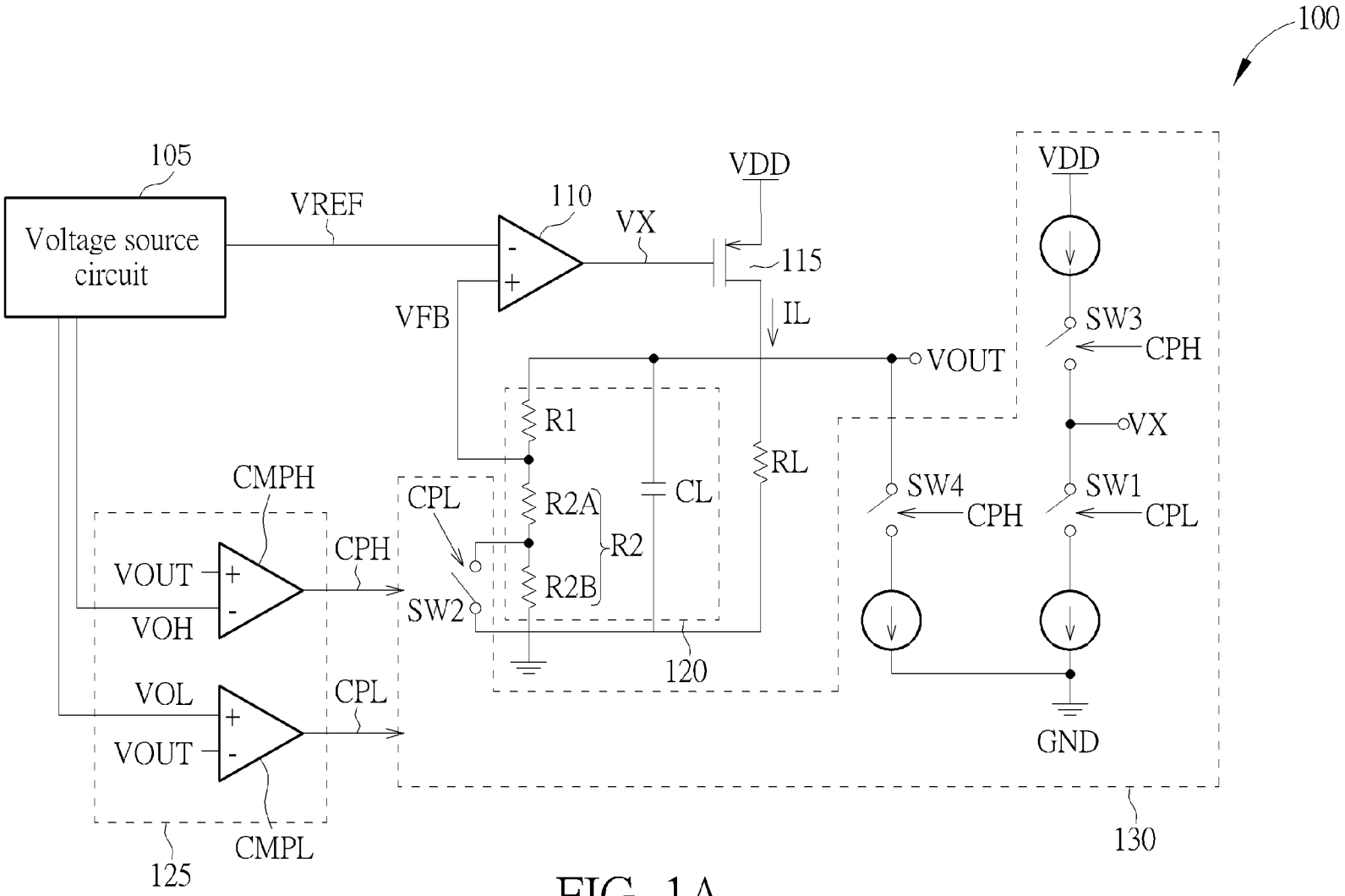
FIG. 1A is a circuit diagram illustrating a low-dropout voltage regulator apparatus according to an exemplary embodiment of the present invention.

Please refer to FIG. 1A, which is a circuit diagram illustrating a low-dropout voltage regulator apparatus 100 according to a preferred embodiment of the present invention. The low-dropout voltage regulator apparatus 100 includes a voltage source circuit 105, an error amplifier 110, an output transistor 115, a resistor-capacitor (RC) circuit 120, a detection circuit 125 and a current adjusting circuit 130. The voltage source circuit 105 is arranged to generate a reference voltage signal VREF and at least one threshold voltage signal. In this embodiment, the voltage source circuit 105 is capable of generating two different threshold voltage signals VOL and VOH, wherein the threshold voltage signals VOL and VOH are a lower-bound voltage signal and an upper-bound voltage signal, respectively. The threshold voltage signals VOL and VOH are provided as reference for the detection circuit 125 to generate control voltage signals for the following circuit(s). The error amplifier 110 is coupled to the voltage source circuit 105, and arranged to receive the reference voltage signal VREF and a feedback voltage signal VFB to generate an output control signal VX. The output transistor 115 has its gate terminal coupled to an output terminal of the error amplifier 110, and is arranged to receive the output control signal VX. The output transistor 115 determines its conduction degree according to the output control signal VX so as to decide the amount of current passing through the output transistor 115, therefore providing an output current (i.e. load current) IL to the output terminal of the low-dropout voltage regulator apparatus 100 for the following circuit(s). The output current IL passes through a load resistor RL and forms an output voltage VOUT. The resistor-capacitor circuit 120 includes a load capacitor CL and a plurality of resistors R1, R2, wherein the resistor R2 includes resistors R2A and R2B. The load capacitor CL is connected with the resistors R1, R2 in a parallel fashion, and the feedback voltage signal VFB is generated by performing voltage dividing through resistors R1 and R2 according to an output voltage VOUT corresponding to the output current IL. The feedback voltage signal VFB is fed back to a non-inverting input terminal ("+") of the error amplifier 110, wherein the reference voltage signal VREF is fed into an inverting input terminal ("−") of the error amplifier 110.

Figure 2:
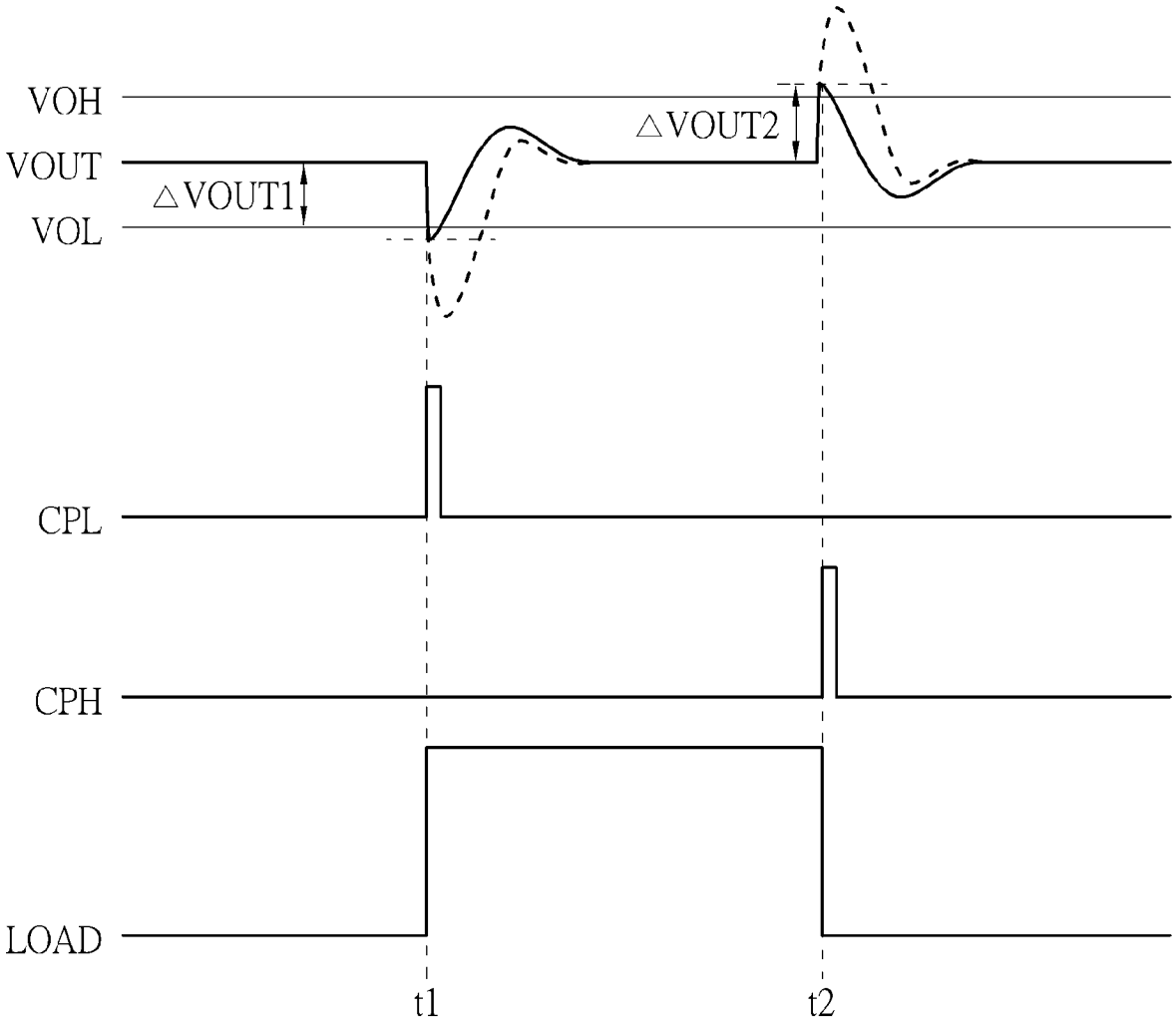
FIG. 2 is a simplified waveform diagram illustrating the output voltage VOUT of the low-dropout voltage regulator apparatus shown in FIG. 1A under different loads.

In this embodiment, in order to reduce the suddenly dramatic change of the load current IL which leads to excessive voltage variation of the output voltage VOUT, the upper-bound voltage signal VOH and the lower-bound voltage signal VOL are provided. It can be determined if the output voltage VOUT has an excessive variation by utilizing the detection circuit 125 to check if the output voltage VOUT exceeds the upper-bound voltage signal VOH or goes below the lower-bound voltage signal VOL. When the load current IL changes excessively and makes the output voltage VOUT suddenly have a excessively high or low voltage, the current adjusting circuit 130 will be controlled according to the detection result of the detection circuit 125 to adaptively/dynamically adjust the current IL passing through the output transistor 115, so as to mitigate the phenomenon of the excessive changes of the output voltage VOUT as well as to reduce the transient response time. Please refer to FIG. 2 in conjunction with FIG. 1A. FIG. 2 is a simplified waveform diagram illustrating the output voltage VOUT of the low-dropout voltage regulator apparatus 100 shown in FIG. 1A under different loads. As shown in FIG. 2, a curve LOAD represents the load change of the low-dropout voltage regulator apparatus 100 along a timeline. Before a time point t1, the low-dropout voltage regulator apparatus 100 is operated in a light load status. From the time point t1 to a time point t2, the low-dropout voltage regulator apparatus 100 is operated in a heavy load status. After the time point t2, the low-dropout voltage regulator apparatus 100 is operated in the light load status again. In other words, at time point t1, the low-dropout voltage regulator apparatus 100 has it load switched from the light load to the heavy load; and at time point t2, the low-dropout voltage regulator apparatus 100 has it load switched from the heavy load to the light load. In addition, the dotted line of the output voltage VOUT represents the behavior of the output voltage in a conventional design. As shown in FIG. 2, the dotted line indicates that the output voltage VOUT in the conventional design goes excessively high or low while switching between different loads, and the generated transient response makes the output voltage seriously unstable. On the other hand, the solid line of the output voltage VOUT represents the behavior of the output voltage of the voltage regulator apparatus 100. As shown in FIG. 2, by using the detection circuit 125 and the current adjusting circuit 130, the current of the output transistor 115 is instantly controlled and adjusted at the upper-bound voltage signal VOH or the lower-bound voltage signal VOL while the output voltage VOUT suddenly has a voltage jump or voltage dip. This substantially achieves the effect of instantly adjusting the output voltage VOUT, and therefore avoids the dramatic voltage changes. In this way, a more stable output voltage is provided for the following circuit(s). In other words, the low-dropout voltage regulator apparatus 100 disclosed in the present invention is capable of configuring the upper-bound voltage signal VOH and the lower-bound voltage signal VOL. When the output voltage VOUT suddenly changes and exceeds the upper-bound voltage signal VOH or goes below the lower-bound voltage signal VOL, the voltage of the output voltage VOUT can be pulled back to a reasonable range (i.e. the region defined between the upper-bound voltage signal VOH and the lower-bound voltage signal VOL through adaptively charging or discharging (i.e. current adjustment). Hence, the dramatic voltage changes suffered in the conventional designs are avoided.

Figure 1B:
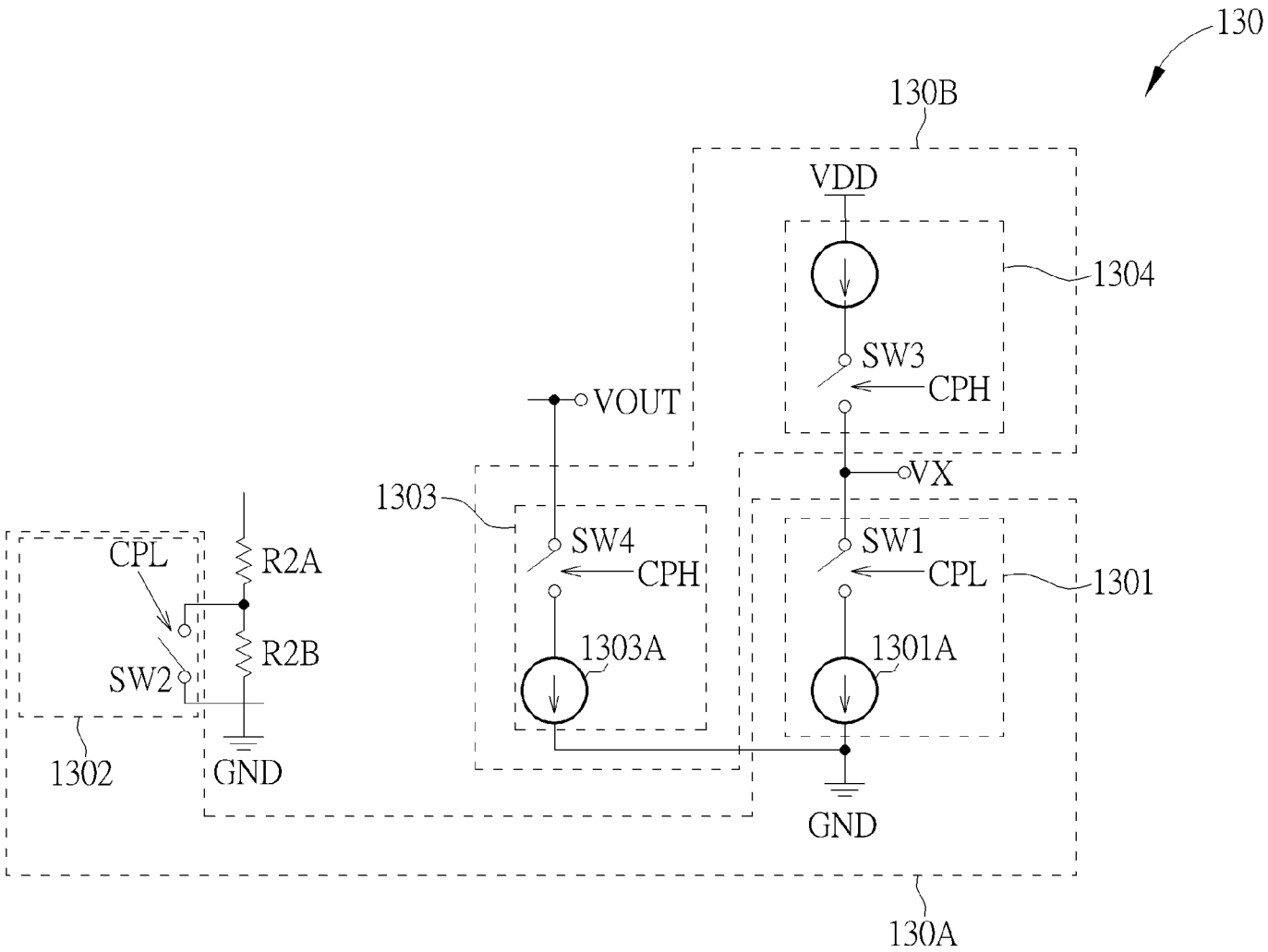
FIG. 1B is an enlarged circuit diagram illustrating the current adjustment circuit shown in FIG. 1A.

Please refer to FIG. 1B in conjunction with FIG. 1A and FIG. 2, wherein FIG. 1B is an enlarged circuit diagram illustrating the current adjustment circuit 130 shown in FIG. 1A. In practice, the detection circuit 125 includes two comparator circuits CMPH and CMPL. The inverting input terminal of the comparator circuit CMPH is coupled to the voltage source circuit 105, and is utilized to receive the upper-bound voltage signal VOH, and the non-inverting input terminal of the comparator circuit CMPH is utilized to receive the output voltage VOUT. The comparator circuit CMPH is used to compare the upper-bound voltage signal VOH with the output voltage VOUT to generate a control voltage signal CPH. Once the output voltage VOUT exceeds the upper-bound voltage signal VOH, the generated control voltage signal CPH will have a high logic level (which may be regarded as a first logic level); on the other hand, if the output voltage VOUT does not exceed the upper-bound voltage signal VOH, the generated control voltage signal CPH will have a low logic level (which may be regarded as a second logic level). The comparator circuit CMPH outputs the control voltage signal CPH to the current circuit 130, such that the control voltage signal CPH with different logic levels at different kinds of situations can be used to dynamically control the current adjustment. In addition, the non-inverting input terminal of the comparator circuit CMPL is coupled to the voltage source circuit 105, and is used to receive the lower-bound voltage signal VOL, and the inverting input terminal is used to receive the output voltage VOUT. The comparator circuit CMPL is used to compare the lower-bound voltage signal VOL with the output voltage VOUT to generate a control voltage signal CPL. Once the output voltage VOUT drops below the lower-bound voltage signal VOL, the generated control voltage signal CPL will have a high logic level (which may be regarded as a first logic level); on the other hand, once the output voltage VOUT is not lower than the lower-bound voltage signal VOL, the generated control voltage signal CPL will have a low logic level (which may be regarded as a second logic level). The comparator circuit CMPL outputs the control voltage signal CPL to the current circuit 130, such that the control voltage signal CPL with different logic levels at different kinds of situations can be used to dynamically control the current adjustment.

Moreover, the current adjusting circuit 130 possesses a charging/discharging adjusting function, and includes two different current adjusting modules 130A and 130B. The current adjusting module 130A is a lower-bound current adjusting module, while the current adjusting module 130B is an upper-bound current adjusting module. The lower-bound current adjusting module 130A includes discharging circuits 1301 and 1302, and the upper-bound current adjusting module 130B includes a discharging circuit 1303 and a charging circuit 1304. The discharging circuits 1301 and 1302 are used to receive the control voltage signal CPL, and discharge the output control signal VX generated by the error amplifier 110 according to the control voltage signal CPL, so as to increase the current passing through the output transistor 115 and reduce the transient response time. A switch SW1 and a discharging unit 1301A are included in the discharging circuit 1301, wherein the switch SW1 is coupled to the output control signal VX generated by the error amplifier 110 (i.e., the switch SW1 is coupled to the output terminal of the error amplifier 110) and controlled by the control voltage signal CPL, and the discharging unit 1301A is coupled between the switch SW1 and a ground level GND, and used to selectively perform a discharging operation according to the status of the switch SW1. When the control voltage signal CPL is at the high logic level, the switch SW1 is turned on to act as a closed circuit, thus forming a discharging path. The discharging unit 1301A can discharge the output control signal VX generated by the error amplifier 110. When the control voltage signal CPL is at the low logic level, the switch SW1 is turned off to act as an open circuit, thus breaking the discharging path. The discharging unit 1301A stops discharging the output control signal VX generated by the error amplifier 110. Besides, the discharging circuit 1302 further includes a switch SW2 which is coupled to a voltage-dividing point corresponding to the feedback voltage signal VFB between the ground level GND and the resistor-capacitor circuit 120. The switch SW2 selectively discharges the voltage of the voltage-dividing point according to the control voltage signal CPL. Specifically, the voltage-dividing point is located between resistors R2A and R2B. When the control voltage signal CPL is at the high logic level, the switch SW2 is turned on to act as a closed circuit, thus forming a discharging path via connecting the voltage-dividing point to the ground level. The voltage level at the voltage-dividing point is discharged and then reduced. When the control voltage signal CPL is at the low logic level, the switch SW2 is turned off to act as an open circuit, thus breaking the discharging path. Due to the fact that the voltage-dividing point is not connected to the ground level, the voltage level at the voltage-dividing point is not discharged or reduced. It should be noted that, in the embodiment shown in FIG. 1B, the purpose of using the switch SW2 is to provide a larger voltage drop for the feedback voltage signal VFB to thereby force the error amplifier 110 to reach a stable status more rapidly and make the overall system locking time of the low-dropout voltage regulator apparatus 100 reduced. The switch SW2 may be an optional element. In other words, the switch SW2 could be omitted in the lower-bound current adjusting module in alternative embodiments. This also belongs to the scope of the present invention.

In addition, it should be noted that the circuit architecture of the lower-bound current adjusting module 130A is based on the characteristics of the output transistor 115. In this embodiment, the output transistor 115 is implemented by a P-type transistor. Hence, in order to pull the excessively low output voltage VOUT back to a normal region, the lower-bound current adjusting module 130A discharges the signal (i.e. the signal VX) at the gate terminal of the output transistor 115 to increase the conduction degree of the output transistor 115 for increasing the current passing through the output transistor 115 as well as the voltage level of the output voltage VOUT when performing the current adjustment. In another embodiment, the output transistor 115 is implemented by an N-type transistor. Hence, the signal (i.e. the signal VX) at the gate terminal of the output transistor 115 is charged to increase the conduction degree of the output transistor 115 for increasing the current passing through the output transistor 115 as well as the voltage level of the output voltage VOUT when performing the current adjustment. In practice, what is included in the lower-bound current adjusting module under such a condition should be a charging circuit instead of a discharging circuit.

As shown in FIG. 2, at time point t1, the low-dropout voltage regulator apparatus 100 is switched from the light load status to the heavy load status; meanwhile, the current passing through the transistor 115 increases rapidly, thus making the voltage level of the output voltage VOUT suddenly changed. Then, a voltage dip happens to the output voltage VOUT due to the load characteristic, and causes a result that the output voltage VOUT drops below the lower-bound voltage signal VOL. When the output voltage VOUT becomes lower than the lower-bound voltage signal VOL, the comparator circuit CMPL shown in FIG. 1A is capable of detecting the sudden voltage drop of the output voltage VOUT and generating the control voltage signal CPL with a high logic level to the current adjusting circuit 130. In this way, the current adjusting circuit 130 can respond to the voltage dip of the output voltage VOUT immediately. Therefore, the conduction degree of the output transistor 115 is increased, and the voltage level of the output voltage VOUT is pulled up correspondingly. Because an instant response is performed upon detection of the voltage dips, the voltage dip is limited within a voltage range ΔVOUT1, thereby mitigating the effect of voltage drop induced by the transient response and supplying a more stable output voltage to the following circuit(s).

With regard to the current adjusting module 130B shown in FIG. 1B, it includes a discharging circuit 1303 and a charging circuit 1304. The charging circuit 1304 is used to receive the control voltage signal CPH and to charge the output control signal VX generated by the error amplifier 110 according to the control voltage signal CPH, so as to decrease the current passing through the output transistor 115 and reduce the transient response time. However, the discharging circuit 1303 is used to receive the control voltage signal CPH and to discharge the output voltage COUT at the output terminal, so as to decrease the voltage level of the output voltage VOUT. A switch SW3 and a charging unit 1304A are included in the charging circuit 1304, wherein the switch SW3 is coupled to the output control signal VX generated by the error amplifier 110 (i.e., the switch SW3 is coupled to the output terminal of the error amplifier 110) and controlled by the control voltage signal CPH, and the charging unit 1304A is coupled between the switch SW3 and a power source VDD and used to selectively perform a charging operation according to the status of the switch SW3. When the control voltage signal CPH is at the high logic level, the switch SW3 is be turned on to act as a closed circuit, thus forming a charging path. The charging unit 1304A can charge the output control signal VX generated by the error amplifier 110. When the control voltage signal CPH is at the low logic level, the switch SW3 is turned off to act as an open circuit, thus breaking the charging path. The charging unit 1304A stops charging the output control signal VX generated by the error amplifier 110. Besides, the discharging circuit 1303 includes a switch SW4 and a discharging unit 1303A, wherein the switch SW4 is coupled to the output terminal of the apparatus 100 (i.e., the switch SW4 is connected to the output voltage signal VOUT), and the discharging unit 1303A is coupled between the switch SW4 and the ground level GND. The discharging unit 1303A selectively performs the discharging operation according to the status of the switch SW4. When the control voltage signal CPH is at the high logic level, the switch SW4 is turned on to act as a closed circuit, thus forming a discharging path. Therefore, the discharging unit 1303A can discharge the output current at the output terminal. When the control voltage signal CPH is at the low logic level, the switch SW4 is turned off to act as an open circuit, thus breaking the discharging path. Therefore, the discharging unit 1303A stops discharging the output current at the output terminal.

It should be noted that the circuit architecture of the upper current limit adjusting module 130B is based on the characteristics of the output transistor 115. In this embodiment, the output transistor 115 is implemented by a P-type transistor. Hence, in order to pull the excessively low output voltage VOUT back to a normal region, the upper-bound current adjusting module 130B charges the signal (i.e., the signal VX) at the gate terminal of the output transistor 115 to decrease the conduction degree of the output transistor 115 for reducing the current passing through the output transistor 115 and the voltage level of the output voltage VOUT when performing the current adjustment. In another embodiment, the output transistor 115 is implemented by an N-type transistor. Hence, the upper-bound current adjusting module 130B discharges the signal (i.e., the signal VX) at the gate terminal of the output transistor 115 to decrease the conduction degree of the output transistor 115 for reducing the current passing through the output transistor 115 and the voltage level of the output voltage VOUT when performing the current adjustment. Therefore, in practice, what is included in the upper-bound current adjusting module should be a discharging circuit instead of a charging circuit.

As shown in FIG. 2, at time point t2, the low-dropout voltage regulator apparatus 100 is switched from the heavy load status to the light load status; meanwhile, the current passing through the transistor 115 decreases rapidly, thus making the voltage level of the output voltage VOUT suddenly changed. Then a voltage jump happens to the output voltage VOUT due to the load characteristic, and causes a result that the output voltage VOUT goes higher than the upper voltage limit VOH. When the output voltage VOUT becomes higher than the upper voltage limit VOH, the comparator circuit CMPH shown in FIG. 1A is capable of detecting the sudden voltage jump of the output voltage VOUT and generating the control voltage signal CPH with a high logic level to the current adjusting circuit 130. In this way, the current adjusting circuit 130 can respond to the voltage jump of the output voltage VOUT immediately. Therefore, the conduction degree of the output transistor 115 is decreased, and the voltage level of the output voltage VOUT is pulled down. Because an instant response is performed upon detection of the voltage jump, the voltage jump is limited within a voltage range ΔVOUT2, thus mitigating the effect of voltage jump induced by the transient response and supplying a more stable output voltage to the following circuit(s).

Figure 3A:
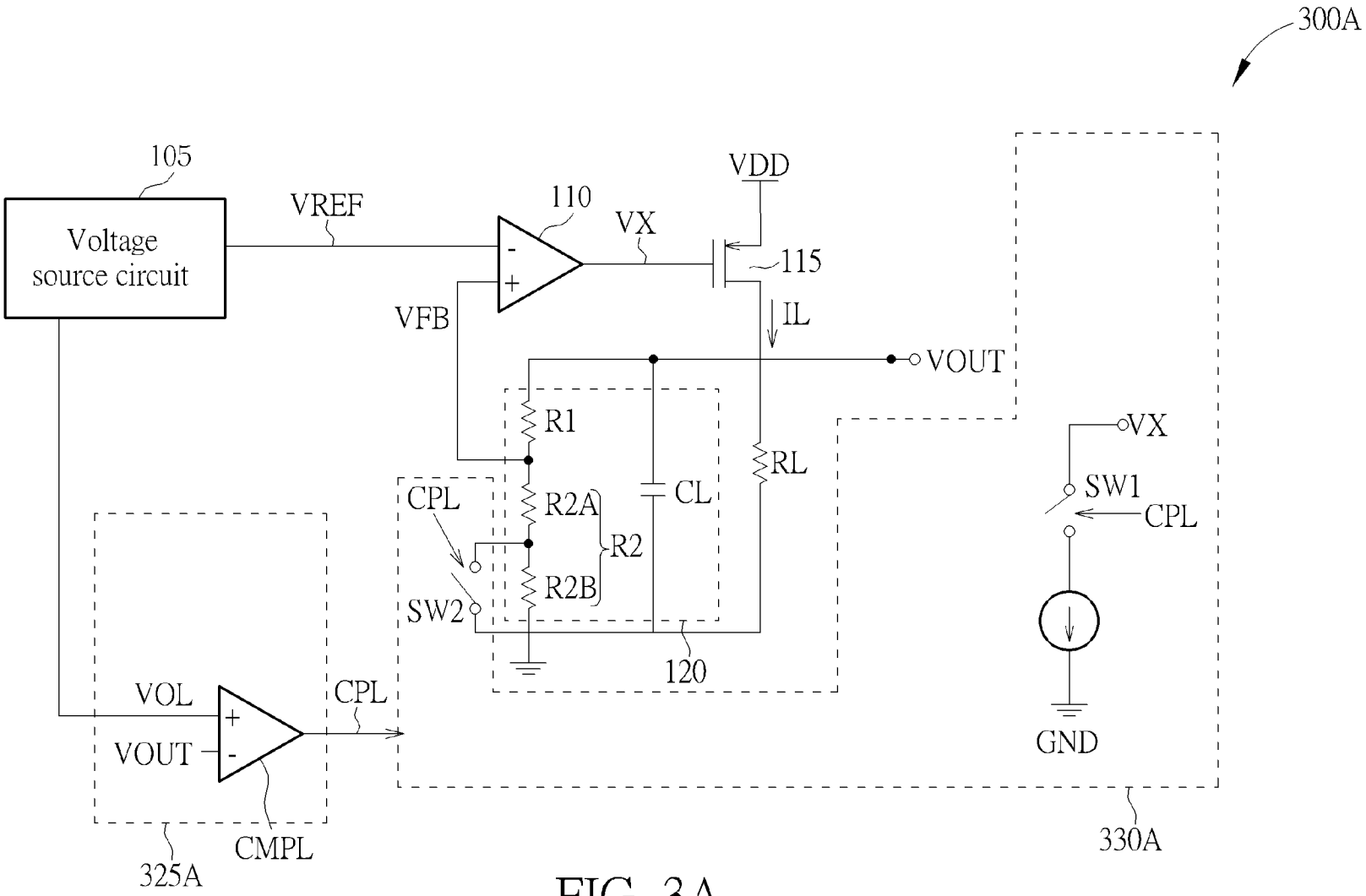
FIG. 3A is a low-dropout voltage regulator apparatuses according to another embodiment of the present invention.
Figure 3B:
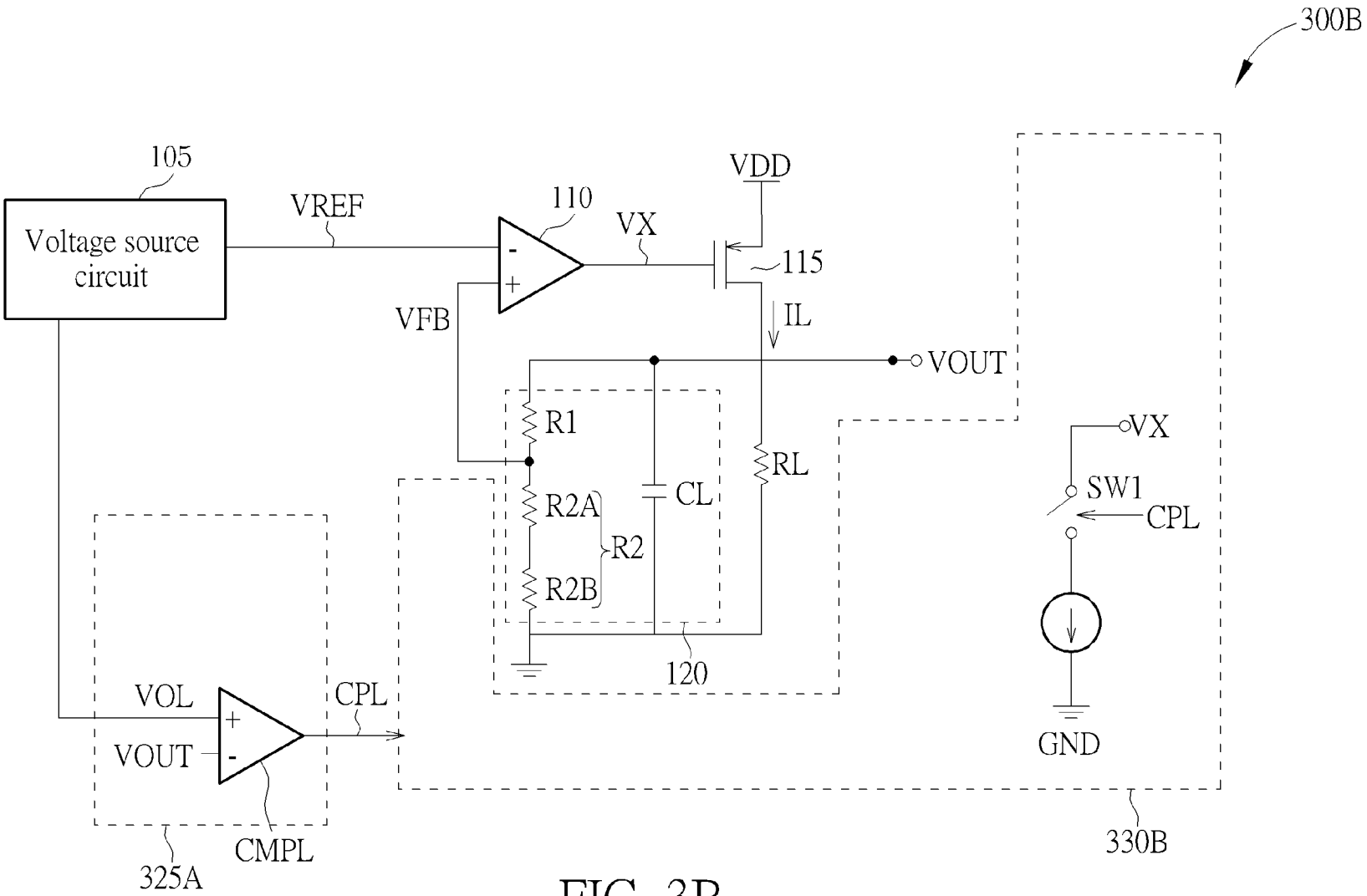
FIG. 3B is a low-dropout voltage regulator apparatuses according to yet another embodiment of the present invention.
Figure 3C:
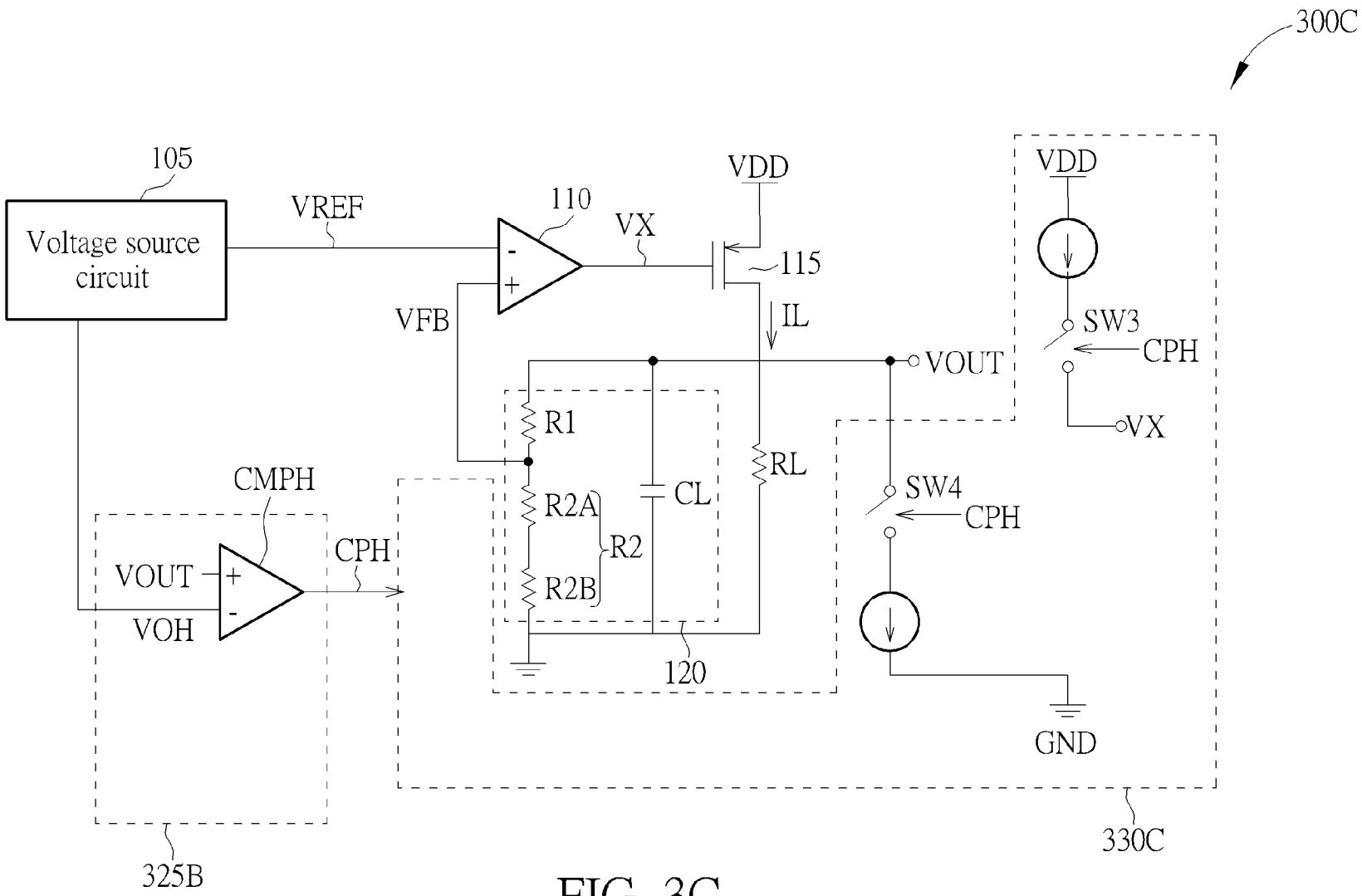
FIG. 3C is a low-dropout voltage regulator apparatuses according to still yet another embodiment of the present invention.

In addition, in the present invention, the upper-bound current adjustment mechanism and the lower-bound current adjustment mechanism are not required to be implemented in a single hardware device. To put it another way, in other embodiments, the upper-bound current adjustment mechanism and the lower-bound current adjustment mechanism may be designed separately for production cost considerations. In addition, the current adjustment mechanism could have a variety of alternative embodiments. Please refer to FIG. 3A-FIG. 3C, which are low-dropout voltage regulator apparatuses according to different embodiments of the present invention. As shown in FIG. 3A, the low-dropout voltage regulator apparatus 300A includes a power source circuit 105, an error amplifier 110, an output transistor 115, a resistor-capacitor circuit 120, a detecting circuit 325A, and a current adjusting circuit 330A. The low-dropout voltage regulator apparatus 300A only possesses the lower-bound current adjustment mechanism (without the upper-bound current adjustment mechanism). And the detecting circuit 325A only includes a comparator circuit CMPL used to perform the detection function for the lower-bound current adjustment (without a comparator circuit CMPH used to perform the detection function for the upper-bound current adjustment). Besides, the current adjusting circuit 330A only includes components of the lower-bound current adjusting module 130A shown in FIG. 1B (without components of the upper-bound current adjusting module 130A). Furthermore, as shown in FIG. 3B, the low-dropout voltage regulator apparatus 300B only possesses the lower-bound current adjustment mechanism (without the upper-bound current adjustment mechanism). The difference between the embodiment shown in FIG. 3B and the embodiment shown in FIG. 3A is that the current adjusting circuit 330B of the low-dropout voltage regulator apparatus 300B does not include the switch SW2 shown in FIG. 3A. Moreover, as shown in FIG. 3C, the low-dropout voltage regulator apparatus 300C only possesses the upper-bound current limit adjustment mechanism (without the lower-bound current adjustment mechanism). The low-dropout voltage regulator apparatus 300C includes a power source circuit 105, an error amplifier 110, an output transistor 115, a resistor-capacitor circuit 120, a detecting circuit 325B, and a current adjusting circuit 330C. What is different from the embodiments shown in FIG. 1A and FIG. 1B is that the detecting circuit 325B includes a comparator circuit CMPH used to perform the detection function for the upper-bound current limit (without the comparator circuit CMPL used to perform the detection function for the lower-bound current adjustment). Besides, the current adjusting circuit 330C only includes components of the upper-bound current adjusting module 130B shown in FIG. 1B (without components of the lower-bound current adjusting module 130A). Please note that the above-described alternative designs all comply with the spirit of the present invention and belong to the scope of the present invention.

In summary, the characteristic of the present invention is using at least one threshold voltage (i.e., an upper-bound voltage or a lower-bound voltage) and an output voltage to generate a comparison result for dynamically adjusting the conduction degree of an output transistor of a low-dropout voltage regulator apparatus, so as to achieve the purpose of instant output voltage adjustment. Therefore, once the variation of the output voltage exceeds the range defined by the threshold voltage, the output voltage will be adjusted instantly, thereby stabilizing the output voltage and reducing the transient response time while switching between different loads.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A low-dropout voltage regulator apparatus, comprising:

a voltage source circuit, arranged to generate a reference voltage signal and at least one threshold voltage signal;

an error amplifier, coupled to the voltage source circuit, the error amplifier arranged to receive the reference voltage signal and a feedback voltage signal to generate an output control signal;

an output transistor, coupled to the error amplifier, the output transistor arranged to receive the output control signal and provide an output current for the output terminal according to the output control signal;

a resistor-capacitor circuit, coupled to the error amplifier and the output transistor, the resistor-capacitor circuit arranged to generate the feedback voltage signal by performing voltage dividing according to a voltage corresponding to the output current;

a detection circuit, coupled to the voltage source circuit, the detection circuit arranged to receive the at least one threshold voltage signal and an output voltage at the output terminal, and compare the at least one threshold voltage signal with the output voltage to generate at least one control voltage signal; and a current adjusting circuit, coupled to the output terminal, the detection circuit and the error amplifier, the current adjusting circuit arranged to adjust the output control signal generated by the error amplifier and adaptively adjust a current passing through the output transistor according to the at least one control voltage signal, so as to decrease a transient response time of the low-dropout voltage regulator.

2. The low-dropout voltage regulator apparatus of claim 1, wherein the detection circuit comprises a first comparator circuit arranged to compare a first threshold voltage signal with the output voltage to generate a first control voltage signal; when the output voltage is lower than the first threshold voltage signal, the first control voltage signal has a first logical level; and when the output voltage is higher than the first threshold voltage signal, the first control voltage signal has a second logical level.

3. The low-dropout voltage regulator apparatus of claim 2, wherein the current adjusting circuit further comprises a lower-bound current adjusting module; when the first control voltage signal has the first logical level, the lower-bound current adjusting module adjusts a current of the output control signal generated by the error amplifier to increase a conduction degree of the output transistor for increasing the current passing through the output transistor; and when the first control voltage signal has the second logical level, the lower-bound current adjusting module does not adjust the current of the output control signal generated by the error amplifier.

4. The low-dropout voltage regulator apparatus of claim 3, wherein the output transistor is a P-type transistor, and the lower-bound current adjusting module comprises:

a first switch, coupled to the output control signal generated by the error amplifier; and a first discharging unit, coupled between the first switch and a ground level, the first discharging unit arranged to selectively perform a discharging operation according to a status of the first switch;

wherein when the first control voltage signal has the first logical level, the first switch is turned on to act as a closed circuit, thus allowing the first discharging unit to perform the discharging operation upon the output control signal generated by the error amplifier; and when the first control voltage signal has the second logical level, the first switch is turned off to act as an open circuit, thus preventing the first discharging unit from performing the discharging operation upon the output control signal.

5. The low-dropout voltage regulator apparatus of claim 3, wherein the lower-bound current adjusting module comprises:

a second switch, coupled to a ground level and a voltage-dividing point of the resistor-capacitor circuit, wherein the voltage-dividing point corresponds to the feedback voltage signal, and the second switch is arranged to selectively perform a discharging operation upon the voltage of the voltage-dividing point according to the first control voltage signal;

wherein when the first control voltage signal has the first logical level, the second switch is turned on to act as a closed circuit and performs the discharging operation upon the voltage of the voltage-dividing point; and when the first control voltage signal has the second logical level, the second switch is turned off to act as an open circuit and does not perform the discharging operation.

6. The low-dropout voltage regulator apparatus of claim 1, wherein the detection circuit comprises a second comparator circuit arranged to compare a second threshold voltage signal with the output voltage to generate a second control voltage signal; when the output voltage is lower than the second threshold voltage signal, the second control voltage signal has a first logical level; and when the output voltage is higher than the second threshold voltage signal, the second control voltage signal has a second logical level.

7. The low-dropout voltage regulator apparatus of claim 6, wherein the current adjusting circuit further comprises an upper-bound current adjusting module; when the second control voltage signal has the first logical level, the upper-bound current adjusting module adjusts a current of the output control signal generated by the error amplifier to decrease a conduction degree of the output transistor for decreasing the current passing through the output transistor; and when the second control voltage signal has the second logical level, the upper-bound current adjusting module does not adjust the current of the output control signal generated by the error amplifier.

8. The low-dropout voltage regulator apparatus of claim 7, wherein the output transistor is a P-type transistor, and the upper-bound current adjusting module comprises:

a third switch, coupled to the output control signal generated by the error amplifier; and a first charging unit, coupled between the third switch and a power source, the first charging unit arranged to selectively perform a charging operation according to a status of the third switch;

wherein when the second control voltage signal has the first logical level, the third switch is turned on to act as a closed circuit, thus allowing the first charging unit to perform the charging operation upon the output control signal generated by the error amplifier; and when the second control voltage signal has the second logical level, the third switch is turned off to act as an open circuit, thus preventing the first charging unit from performing the charging operation upon the output control signal.

9. The low-dropout voltage regulator apparatus of claim 7, wherein when the second control voltage signal has the first logical level, the upper-bound current adjusting module further performs a discharging operation upon the output current of the output terminal to reduce the output voltage of the output terminal and the transient response time; and when the second control voltage signal has the second logical level, the upper-bound current adjusting module does not adjust the current of the output control signal generated by the error amplifier.

10. The low-dropout voltage regulator apparatus of claim 7, wherein the upper-bound current adjusting module comprises:

a fourth switch, coupled to the output terminal; and a second discharging unit, coupled between the fourth switch and a ground level, the fourth switch arranged to selectively perform a discharging operation according to a status of the fourth switch;

wherein when the second control voltage signal has the first logical level, the fourth switch is turned on to act as a closed circuit, thus allowing the second discharging unit to perform the discharging operation upon the output current of the output terminal; and when the second control voltage signal has the second logical level, the fourth switch is turned off to act as an open circuit and does not perform the discharging operation upon the output current of the output terminal.

11. A method used in a low-dropout voltage regulator apparatus, comprising:

utilizing a voltage source circuit to generate a reference voltage signal and at least one threshold voltage signal;

utilizing an error amplifier to receive the reference voltage signal and a feedback voltage signal to generate an output control signal;

utilizing an output transistor to receive the output control signal and provide an output current for the output terminal according to the output control signal;

generating the feedback voltage signal by performing voltage dividing according to a voltage corresponding to the output current;

receiving the at least one threshold voltage signal and an output voltage on the output terminal, and comparing the at least one threshold voltage signal with the output voltage to generate at least one control voltage signal; and adjusting the output control signal generated by the error amplifier and adaptively adjusting a current passing through the output transistor according to the at least one control voltage signal, so as to decrease a transient response time of the low-dropout voltage regulator.

12. The method of claim 11, wherein the step of generating the at least one control voltage signal comprises:

utilizing a first comparator circuit to compare a first threshold voltage signal with the output voltage to generate a first control voltage signal, wherein when the output voltage is lower than the first threshold voltage signal, the first control voltage signal has a first logical level; and when the output voltage is higher than the first threshold voltage signal, the first control voltage signal has a second logical level.

13. The method of claim 12, wherein the first threshold voltage signal is a lower-bound voltage signal, and the step of adaptively adjusting the current passing through the output transistor comprises:

when the first control voltage signal has the first logical level, adjusting the current of the output control signal generated by the error amplifier to increase a conduction degree of the output transistor for increasing the current passing through the output transistor; and when the first control voltage signal has the second logical level, not adjusting the current of the output control signal generated by the error amplifier.

14. The method of claim 13, further comprising:

selectively performing a discharging operation upon a voltage of a voltage-dividing point according to the first control voltage signal, wherein the voltage-dividing point corresponds to the feedback voltage signal;

wherein when the first control voltage signal has the first logical level, the discharging operation is performed upon the voltage-dividing point; and when the first control voltage signal has the second logical level, the discharging operation is not performed upon the voltage-dividing point.

15. The method of claim 11, wherein the step of generating the at least one control voltage signal comprises:

utilizing a second comparator circuit to compare a second threshold voltage signal with the output voltage to generate a second control voltage signal, wherein when the output voltage is lower than the second threshold voltage signal, the second control voltage signal has a first logical level; and when the output voltage is higher than the second threshold voltage signal, the second control voltage signal has a second logical level.

16. The method of claim 15, wherein the second threshold voltage signal is an upper-bound voltage signal, and the step of adaptively adjusting the current passing through the output transistor comprises:

when the second control voltage signal has the first logical level, adjusting the current of the output control signal generated by the error amplifier to decrease a conduction degree of the output transistor for decreasing the current passing through the output transistor; and when the second control voltage signal has the second logical level, not adjusting the current of the output control signal generated by the error amplifier.

17. The method of claim 16, further comprising:

when the second control voltage signal has the first logical level, performing a discharging operation upon the output current of the output terminal to reduce the output voltage of the output terminal, so as to decrease the transient response time; and when the second control voltage signal has the second logical level, not performing the discharging operation upon the output current of the output terminal.

* * * * *